US007111370B2

(12) United States Patent
Daniel

(10) Patent No.: US 7,111,370 B2
(45) Date of Patent: Sep. 26, 2006

(54) SANITARY EAR CLIP DISPLAY MEMBER FOR AN EARRING

(76) Inventor: Stella Daniel, 71 Fleetwood Rd., Woodbridge, NJ (US) 07095

( * ) Notice: Subject to any disclaimer, the term of this patent is extended or adjusted under 35 U.S.C. 154(b) by 77 days.

(21) Appl. No.: 10/883,079

(22) Filed: Jul. 1, 2004

(65) Prior Publication Data

US 2006/0000235 A1 Jan. 5, 2006

(51) Int. Cl.
*A44C 7/00* (2006.01)

(52) U.S. Cl. ..... 24/705; 63/12; 63/14.5

(58) Field of Classification Search ..... 63/12, 63/14.1, 14.3–14.5, 13; 24/705, 13
See application file for complete search history.

(56) References Cited

U.S. PATENT DOCUMENTS 511,952 A * 1/1894 Hubash ..... 606/188
3,071,939 A * 1/1963 Feibelman ..... 63/14.1
4,700,552 A * 10/1987 Haley ..... 63/12
4,843,699 A * 7/1989 Seidman ..... 29/896.42

* cited by examiner

*Primary Examiner*—Jack W. Lavinder
(74) *Attorney, Agent, or Firm*—Ezra Sutton, Esq.

(57) ABSTRACT

A sanitary ear clip display member for trying on a pierced-type earring being substantially U-shaped in configuration and having a pin receiving member attached at one end to a movable clip member and the pin receiving member attached at the other end to a second clip member. The ear clip display member also includes a pivot pin and spring member attached to the one end of the pin receiving member; and to one end of the movable clip member. The movable clip member is movable in a spring biased manner from an opened position to a closed position; and the pin receiving member has a pin receiving passageway for receiving a pin of the pierced-type earring therethrough for displaying the pierced-type earring. The clip members and the pin receiving member form the U-shaped configuration for forming a channel therebetween in order to receive an ear lobe therein allowing the user to try on the pierced-type earrings in a sanitary manner.

11 Claims, 6 Drawing Sheets

SANITARY EAR CLIP DISPLAY MEMBER FOR AN EARRING

FIELD OF THE INVENTION

The present invention relates to a sanitary ear clip display member for displaying and showing an earring. More particularly, it relates to a sanitary ear clip display member that attaches to an ear lobe having a pierced-type earring being detachably connected to the ear clip display member. This allows potential purchasers of pierced-type earrings to try on these new earrings without risking any sanitary problems normally associated with multiple purchasers trying on the same pair of earrings by conventionally connecting the pierced-type earrings to the user's ear lobes by a pin and/or clasp.

BACKGROUND OF THE INVENTION

Pierced-type earrings are well known in the art. Woman world wide have pierced ear lobes for wearing of these pierced-type earrings. Typically, when buying these pierced-type earrings the purchaser disengages at least one of the earrings from her ear lobe and tries on one of the new earrings on her ear lobe. In doing this procedure of testing new pierced-type earrings by a potential buyer, her ear lobe may currently have an infection which then is passed on to another purchaser of the same earrings. Further, there is no standard operating procedure for sanitizing these earrings after use by the potential buyer. Additionally, sanitizing by spraying a disinfectant such as alcohol on the pierced-type earrings being tried on may not necessarily kill all of the bacteria on the earring.

There remains a need for a sanitary ear clip display member for use on a woman's ear lobe when trying on new pierced-type earrings in a jewelry store or department store. Additionally, there is a need for a pin receiving member on the ear clip display member for detachably receiving a pin of the pierced-type earring through the pin receiving member in order to display the earring thereon. Further, there is a need for a sanitary ear clip display member which attaches to the pierced-type earring and to the user's ear lobe in order to allow potential buyers of the pierced-type earrings to try on these new earrings without risking any sanitary problems (infections) normally associated with multiple purchasers trying on the same pair of earrings by conventionally connecting the pierced-type earrings to the user's ear lobes by an earring clasp.

DESCRIPTION OF THE PRIOR ART

Cleanable earrings, earring pads for earrings and the like having various designs, structures, configurations and materials of construction have been disclosed in the prior art. For example, U.S. Pat. No. 3,910,065 to HOLT discloses an earring for pierced ears having a pin for passing through the lobe and a one-piece detent sleeve for receiving the portion of the pin which extends beyond the lobe inner surface so that the pin fills the sleeve. The sleeve removes dirt from the pin before it is inserted in to the ear lobe. This prior art patent does not disclose or teach the design, structure and configuration of the present invention.

U.S. Pat. No. 2,763,999 to NORMAN discloses earring pads adapted for earrings of the clip-on and screw-on type. The earring pad device is so constructed that sanitary pads may be attached to both outside and inside clamps. In addition, the pads can be constructed of such material so as to render its cleanable and sanitary, inexpensive, and cost efficient if purchased in bulk. The prior art patent does not disclose or teach the design, structure and configuration of the present invention.

None of these prior art patents teach or disclose a sanitary ear clip display member that can be attached to a person's ear lobe and the earring, such that a pierced-type earring is connected to the ear clip display member in order to facilitate the sanitary trying on of such pierced-type earrings.

Accordingly, it is an object of the present invention to provide a sanitary ear clip display member that attaches to a pierced-type earring and the user's ear lobe in order to allow potential purchasers of pierced-type earrings to try on these new earrings without risking any sanitary problems normally associated with multiple buyers trying on the same pair of earrings by conventionally connecting to the user's ear lobes by an earring clasp.

Another object of the present invention is to provide a sanitary ear clip display member that includes a pin receiving member that detachably receives a pin of the pierced-type earring through the pin receiving member in order to display the earring thereon.

Another object of the present invention is to provide a sanitary ear clip display member that is made of plastic or light-weight metals for ease of cleaning and re-use by buyers for earrings at jewelry stores/department stores.

Another object of the present invention is to provide a sanitary ear clip display member where the pin receiving member is made from materials selected from the group consisting of durable plastic, semi-flexible plastics, porous plastics, sponge-type elements, light-weight metals such as stainless steel or aluminum and the like.

Another object of the present invention is to provide a sanitary ear clip display member that is easily assembled for use, re-cleanable, readily sanitized, durable for long periods of use by users and promotes good personal hygiene.

Another object of the present invention is to provide a sanitary ear clip display member that can be mass produced in an automated and economical manner and is readily affordable by jewelry store owners or department stores.

SUMMARY OF THE INVENTION

In accordance with the present invention, there is provided a sanitary ear clip display member for trying on a pierced-type earring. The ear clip display member is substantially U-shaped in configuration and has a pin receiving member attached at one end to a movable clip member and the pin receiving member is also attached at the other end to a second clip member. The ear clip display member also includes a pivot pin and spring member attached to the one end of the pin receiving member, and to one end of the movable clip member. The movable clip member is movable in a spring biased manner from an opened position to a closed position; and the pin receiving member has a pin receiving passageway for receiving a pin of the pierced-type earring therethrough for displaying the pierced-type earring. The clip members and the pin receiving member form the U-shaped configuration for forming a channel therebetween in order to receive an ear lobe therein allowing the user to try on the pierced-type earrings in a sanitary manner.

BRIEF DESCRIPTION OF DRAWINGS

Further, objects, features and advantages of the present invention will become apparent upon the consideration of the following detailed description of the presently preferred embodiment when taken in conjunction with the accompanying drawings, wherein.

DETAILED DESCRIPTION OF THE PREFERRED AND ALTERNATE EMBODIMENTS

Figure 1:
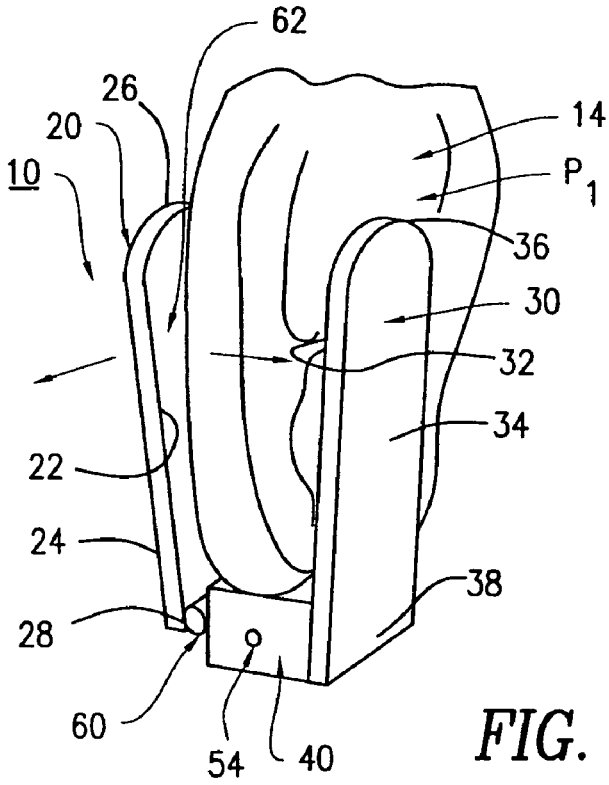
FIG. 1 is an enlarged perspective view of the preferred embodiment of the present invention showing the ear clip display member in its assembled configuration ready for operational use thereof.
Figure 2:
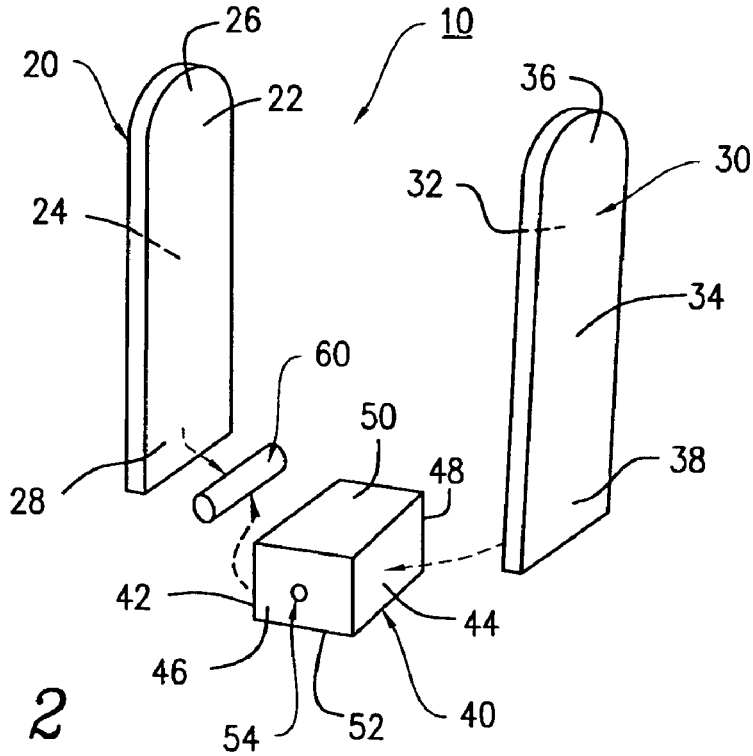
FIG. 2 is an enlarged exploded perspective view of the sanitary ear clip display member of the present invention showing a movable clip member, a fixed clip member, a pin receiving member having a receiving pin passageway and a pivot pin and spring member.

The sanitary ear clip display member 10 for an earring 12 and its component parts of the preferred and alternate embodiments of the present invention are represented in detail by FIGS. 1 through 12 of the patent drawings. The sanitary ear clip display member 10 or 100 are used on a woman's ear lobe 14 when trying on new earrings 12 in a store.

Preferred Embodiment 10

Figure 3:
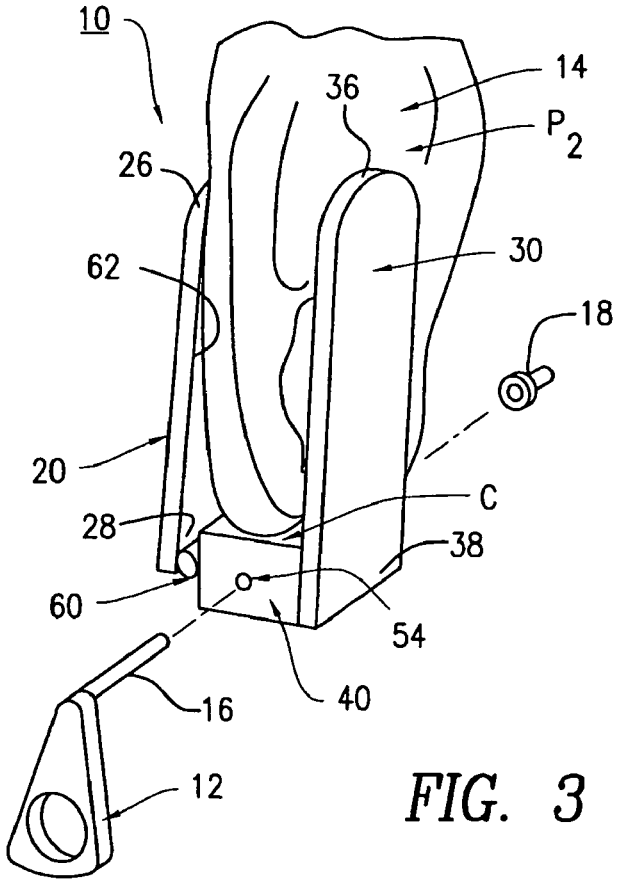
FIG. 3 is an enlarged perspective view of the sanitary ear clip display member of the present invention showing a pin of a pierced-type earring being received within the receiving pin passageway of the pin receiving member and the ear clip display member being in an assembled state for receiving the user's ear lobe.
Figure 4:
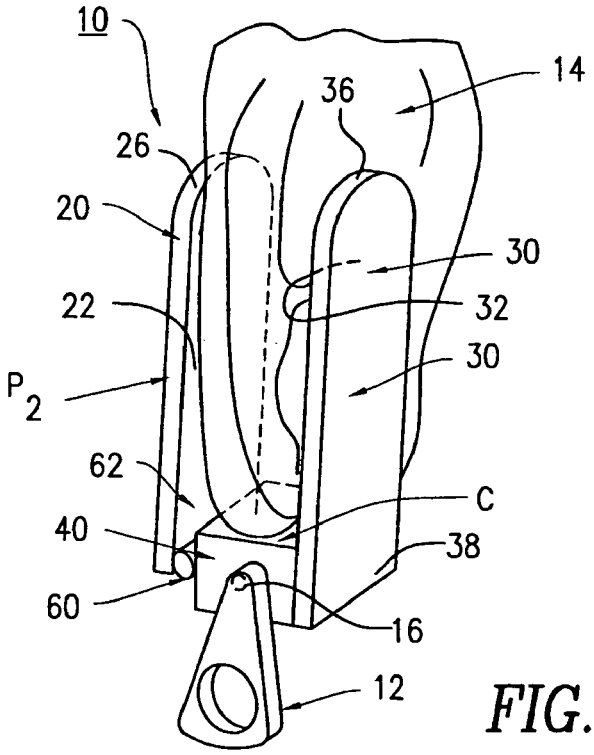
FIG. 4 is an enlarged perspective view of the sanitary ear clip display member of the present invention showing the pierced-type earring being detachably connected to the pin receiving member and in operational use thereof.

As shown in FIGS. 1 through 4, the sanitary ear clip display member 10 for the earring 12 includes a movable clip member 20, a fixed clip member 30, a pin receiving member 40 and a pivot pin and spring member 60. The movable clip member 20 includes an inner surface 22, an outer surface 24, a distal end 26 and a proximal end 28. The fixed clip member 30 includes an inner surface 32, an outer surface 34, a distal end 36 and a proximal end 38. Clip members 20 and 30 can have geometrically-shaped design structures such as rectangles, squares, circles, ovals, triangles and the like. Also, clip members 20 and 30 can have non-geometrically-shaped design structures. The pin receiving member 40 includes a first sidewall surface 42, a second sidewall surface 44, a front wall surface 46, a rear wall surface 48, a top wall surface 50 and a bottom wall surface 52. The pin receiving member 40 includes a receiving pin passageway 54 extending through the entire width of the pin receiving member 40. Passageway 54 is for receiving the pin 16 of a pierced earring 12, as shown in FIGS. 3 and 4 of the patent drawings. Alternatively, passageway 54 may extend only partially through pin receiving member 40. Pin receiving member 40 is made of durable hard plastics, semi-flexible plastics, or lightweight metal materials (such as stainless steel or aluminum).

The proximal end 28 of movable clip member 20 is integrally attached to pivot pin and spring member 60 for moving the movable clip member 20 in a spring-biased manner from an opened position $P_1$ (see FIG. 1) to a closed position $P_2$ (see FIGS. 3 and 4). Pivot pin and spring 60 is also integrally attached to the first sidewall surface 42 of pin receiving member 40. The proximal end 38 of fixed clip member 30 is integrally attached to the second side wall surface 44. Clip members 20 and 30 are made from materials that include hard durable plastics, semi-flexible plastics and light-weight metals such as stainless steel or aluminum. The clip members 20 and 30 and pin receiving member 40 form a U-shaped configuration C having a channel 62 formed therebetween, as depicted in FIGS. 1, 3 and 4 of the drawings. Channel 62 is used to receive a woman's ear lobe 14 therein, as shown in FIG. 4, when she attaches it to her ear lobe 14 to try on pierced earrings 12 in a sanitary manner.

First Alternate Embodiment 100

The sanitary ear clip display member 110 for earring 112 and its component parts of the alternate embodiment 100 of the present invention is represented in detail by FIGS. 5 to 8 of the patent drawings. Elements illustrated in FIGS. 5 to 8 which correspond to the elements described above with reference to FIGS. 1 through 4 have been designated by corresponding reference numbers increased by one hundred. The alternate embodiment 100 is constructed in a similar manner and operates in the same manner as the preferred embodiment 10, unless it is otherwise stated.

The alternate embodiment 100 is exactly the same as the preferred embodiment of the sanitary ear clip display member 10, except for the materials of construction for the pin receiving member 140. Pin receiving member 140 is made from a sponge-like material S or semi-flexible porous plastic material.

Figure 5:
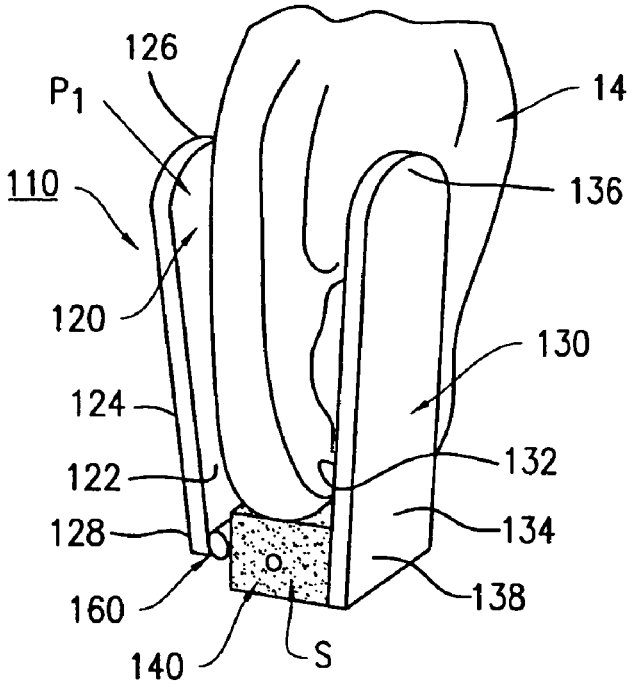
FIG. 5 is an enlarged perspective view of the sanitary ear clip display member of the first alternate embodiment of the present invention showing the ear clip display member in its assembled configuration ready for operational use thereof.
Figure 6:
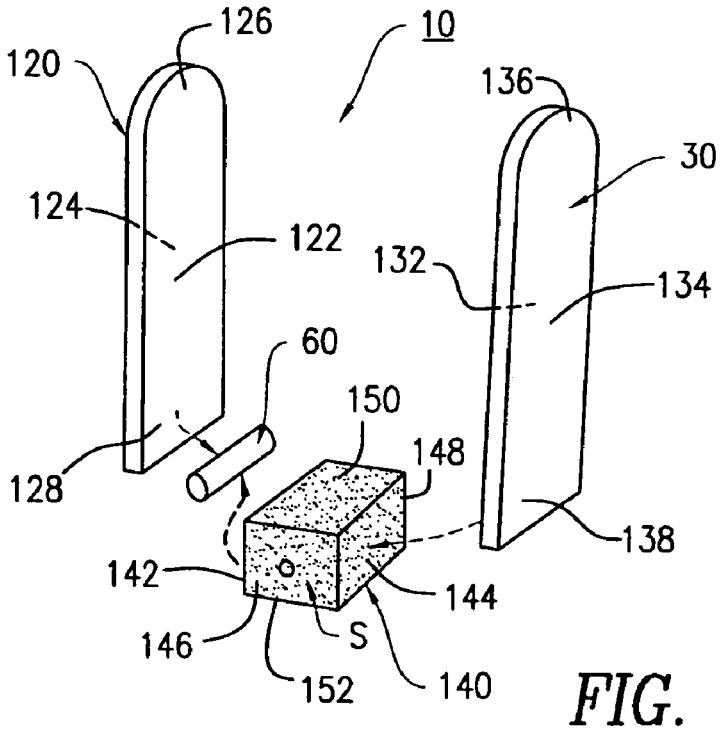
FIG. 6 is an enlarged exploded perspective view of the sanitary ear clip display member of the present invention showing a movable clip member, a fixed clip member, a pin receiving porous member and a pivot pin and spring member.

The pin receiving member 140 does not include a receiving pin passageway 54 because of the nature of the sponge-like material S or porous plastic material P as the pin 116 of pierced earring 112 is readily received within any portion of sponge-like material S or porous plastic material P, as shown in FIGS. 5 and 6 of the drawings. The remaining component parts of the sanitary ear clip display member 110 are exactly the same as the component parts of the sanitary ear clip display member 10 of the preferred embodiment.

Second Alternate Embodiment 200

The sanitary ear clip display member 210 for earring 212 and its component parts of the alternate embodiment 100 of the present invention is represented in detail by FIGS. 9 to 12 of the patent drawings. Elements illustrated in FIGS. 9 to 12 which correspond to the elements described above with reference to FIGS. 1 through 4 have been designated by corresponding reference numbers increased by two hundred. The second alternate embodiment 200 is constructed in a similar manner and operates in the same manner as the preferred embodiment 10, unless it is otherwise stated.

The second embodiment 200 is exactly the same as the preferred embodiment of the sanitary ear clip display member 10, except for a second movable clip member 270 having an inner surface 272, an outer surface 274, a distal end 276 and a proximal end 278. The second movable clip member 270 is directly opposed to a first movable clip member 220. Each of the proximal ends 228 and 278 of the movable clip member 220 and 270 are integrally attached to first and second pivot pin members 260 and 280 for moving each of the movable clip members 220 and 270 in a spring-biased manner from an opened position $P_3$ (see FIG. 9) to a closed position $P_4$ (see FIGS. 11 and 12). The second pivot pin and spring member 280 are integrally attached to the second sidewall surface 242 of pin receiving member 240. The remaining component parts of the sanitary ear clip display member 210 are exactly the same as the component parts of the sanitary ear clip display member 10.

Operation of the Present Invention

Figure 7:
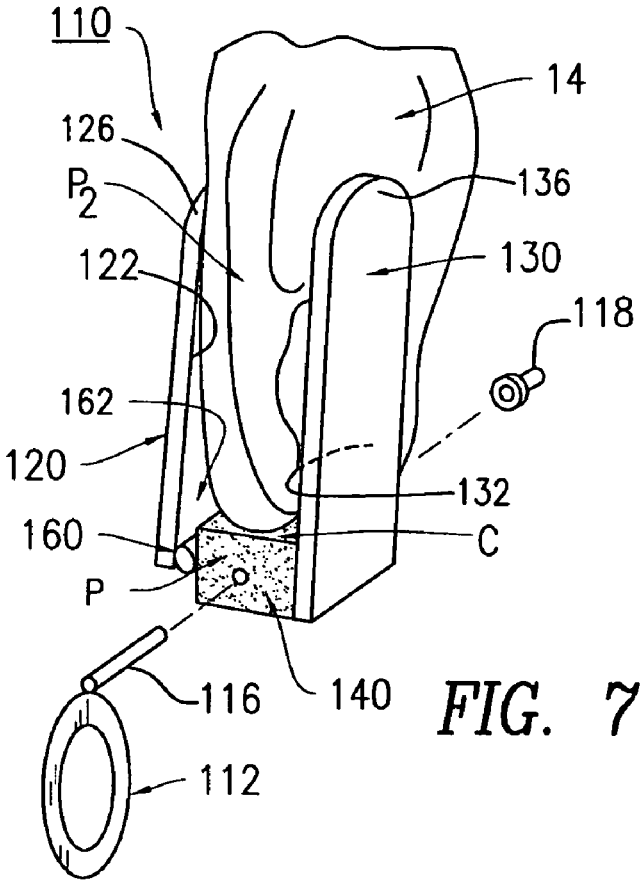
FIG. 7 is an enlarged perspective view of the sanitary ear clip display member of the present invention showing a pin of a pierced-type earring being received within the pin receiving porous member and the ear clip display member being in an assembled state for receiving the user's ear lobe.
Figure 8:
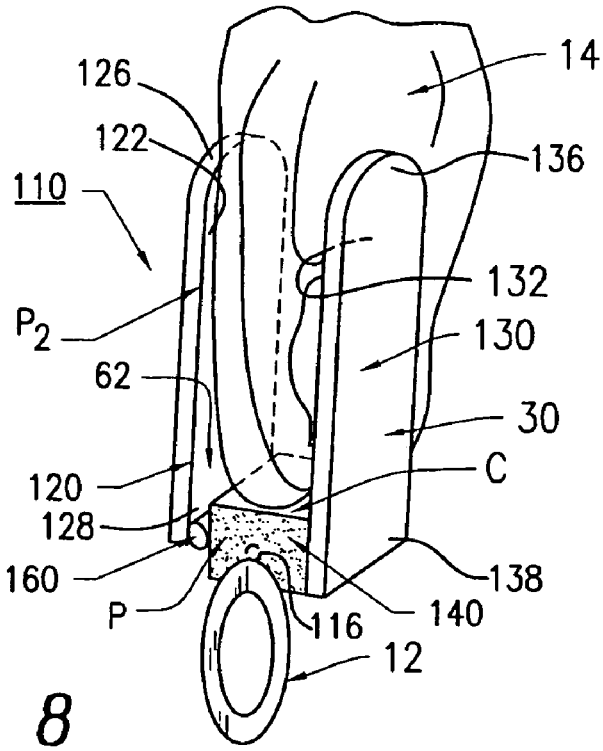
FIG. 8 is an enlarged perspective view of the sanitary ear clip display member of the present invention showing the pierced-type earring being detachably connected to the pin receiving member and in operational use thereof.
Figure 9:
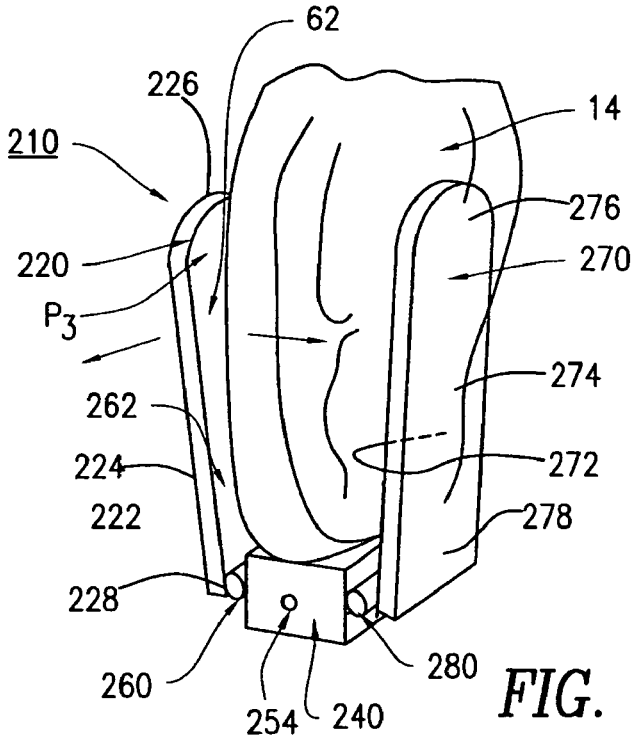
FIG. 9 is an enlarged perspective view of the second alternate embodiment of the present invention showing the ear clip display member in its assembled configuration ready for operational use thereof.
Figure 10:
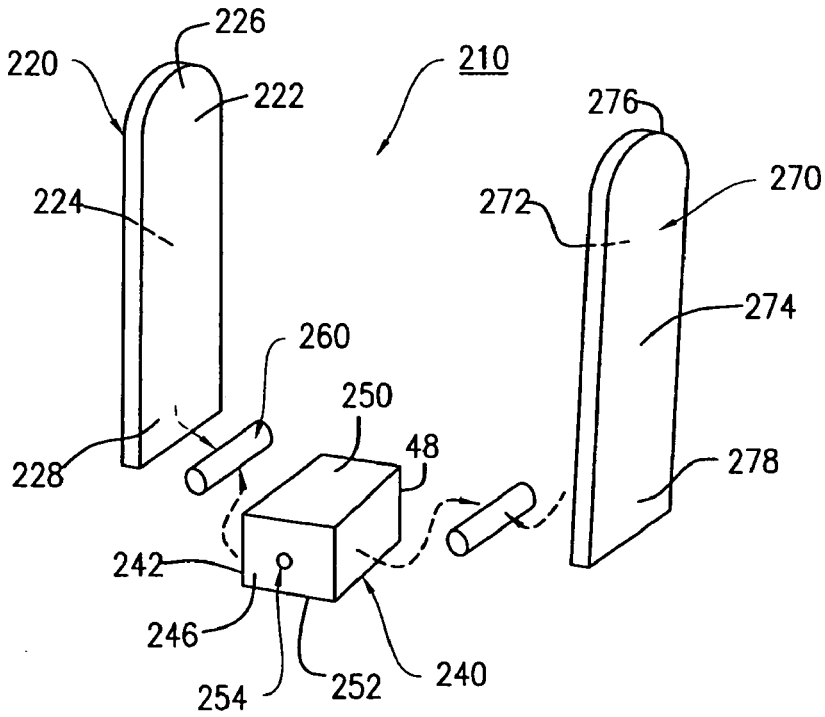
FIG. 10 is an enlarged exploded perspective view of the sanitary ear clip display member of the present invention showing a first movable clip member, a second movable clip member, a pin receiving member having a receiving pin passageway and a pivot pin and spring member.
Figure 11:
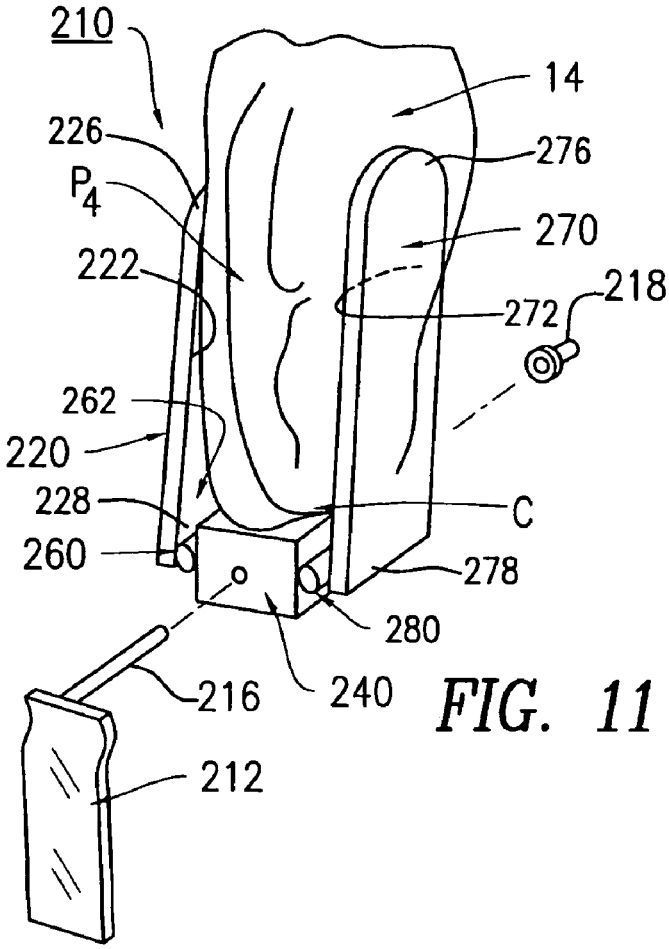
FIG. 11 is an enlarged perspective view of the sanitary ear clip display member of the present invention showing a pin of a pierced-type earring being received within the receiving pin passageway of the pin receiving member and the ear clip display member being in an assembled state for receiving the user's ear lobe.
Figure 12:
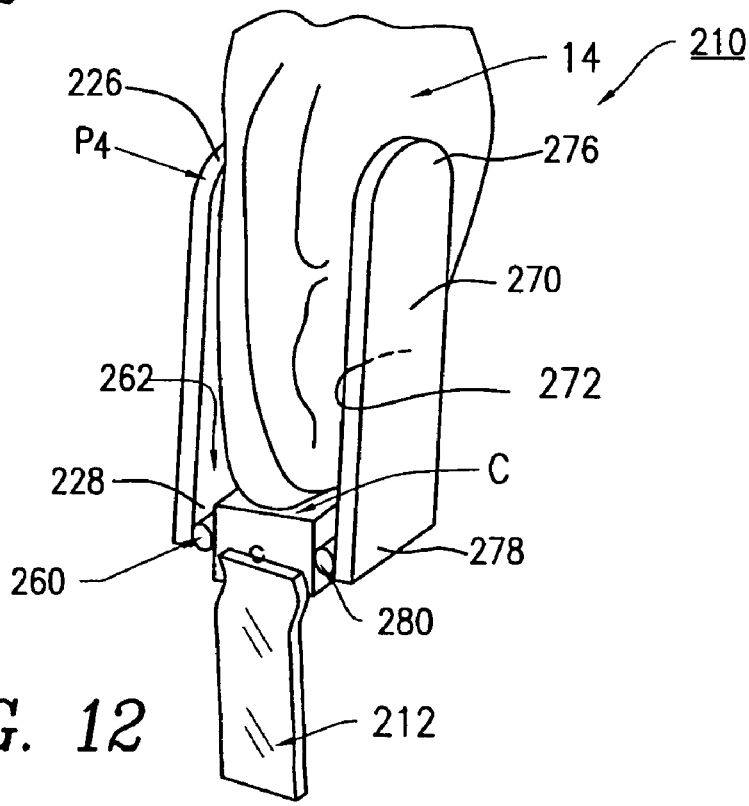
FIG. 12 is an enlarged perspective view of the sanitary ear clip display member of the present invention showing the pierced-type earring being detachably connected to the pin receiving member and in operational use thereof

In using the sanitary ear clip display member 10, 110 or 210 for earrings 12, 112 or 212 by a woman user where the initial step is the insertion of pin 16, 116 or 216 of pierced earrings 12, 112 or 212 within the receiving pin passageway 54 or 254; or within the sponge-like material S or the porous plastic material P, as depicted in FIGS. 3, 7 and 11 of the drawings. The woman user then attaches a pin holding or clasp member 18, 118 or 218 to pin 16 or 116 of pierced earrings 12 or 112, such that pin 16, 116, or 216 cannot be removed from the pin receiving member 40, 140 or 240, as shown in FIGS. 4, 8 and 12 of the drawings. Then the woman user opens the movable clip member 20, 120 and 220 and/or 270 using the spring-biased pivot pin and spring 60, 160 or 260 and 280 to an opened position $P_1$ or $P_3$, and then the woman user inserts her ear lobe 14 within the U-shaped channel 62, 162 or 262. Simultaneously, the woman user then presses the outer surfaces 24 and 34, 124 and 134 or 224 and 274 of clip members 20 and 30, 120 and 130 or 220 and 270, such that the inner surfaces 22 and 32, 122 and 132 or 222 and 272 of clip members 20 and 30, 120 and 130 or 220 and 270 press against the woman's ear lobe 14 in order to hold the sanitary ear clip display member 10, 110 or 210 in place. In this manner, the woman user attaches the ear clip display member 10, 110 or 210 to her ear lobe 14 in order to put on and wear the pierced earrings 12, 112 or 212 in a sanitary condition or manner, without using pin 16, 116 or 216 within the woman's actual ear lobe 14, as shown in FIGS. 4, 8 and 12 of the drawings.

Advantages of the Present Invention

Accordingly, an advantage of the present invention is that it provides for a sanitary ear clip display member that attaches to a pierced-type earring and the user's ear lobe in order to allow potential purchasers of pierced-type earrings to try on these new earrings without risking any sanitary problems normally associated with multiple buyers trying on the same pair of earrings by conventionally connecting the pierced-type earrings to the user's ear lobes by an earring clasp.

Another advantage of the present invention is that it provides for a sanitary ear clip display member that includes a pin receiving member that detachably receives a pin of the pierced-type earring through the pin receiving member in order to display the earring thereon.

Another advantage of the present invention is that it provides for a sanitary ear clip display member that is made of plastic or light-weight metals for ease of cleaning and re-use by buyers for earrings at jewelry stores/department stores.

Another advantage of the present invention is that it provides for a sanitary ear clip display member where the pin receiving member is made from materials selected from the group consisting of durable plastics, semi-flexible plastics, porous plastics, sponge-type elements, light-weight metals such as stainless steel or aluminum and the like.

Another advantage of the present invention is that it provides for a sanitary ear clip display member that is easily assembled for use, re-cleanable, readily sanitized, durable for long periods of use by users and promotes good personal hygiene.

Another advantage of the present invention is that is provides for a sanitary ear clip display member that can be mass produced in an automated and economical manner and is readily affordable by jewelry store owners or department stores.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A sanitary ear clip display member for a pierced-type earring, comprising:

a) an ear clip display member being substantially U-shaped in configuration and having a pin receiving member attached at one end to a movable clip member and said pin receiving member attached at the other end to a second clip member; and said movable clip member and said second clip member having a planar configuration;

b) a pivot pin and spring member attached to said one end of said pin receiving member; and to one end of said movable clip member;

c) said movable clip member being movable in a spring biased manner from an opened position to a closed position;

d) said pin receiving member being positioned parallel relative to each of said clip members;

e) said pin receiving member having a pin receiving passageway for receiving a pin of the pierced-type earring therethrough for displaying the pierced-type earring; and f) said clip members and said pin receiving member form said U-shaped configuration for forming a U-shaped channel therebetween in order to receive an ear lobe therein allowing the user to try on the pierced-type earrings in a sanitary manner.

2. A sanitary ear clip display member in accordance with claim 1, wherein said receiving pin passageway extends the entire width of said pin receiving member.

3. A sanitary ear clip display member in accordance with claim 1, wherein said receiving pin passageway extends only partially through the width of said pin receiving member.

4. A sanitary ear clip display member in accordance with claim 1, wherein said pin receiving member is made of durable hard plastics, semi-flexible plastics, or light-weight metals such as stainless steel or aluminum.

5. A sanitary ear clip display member in accordance with claim 1, wherein said clip members are made from materials that includes hard durable plastics, semi-flexible plastics and light-weight metal materials such as stainless steel or aluminum.

6. A sanitary ear clip display member in accordance with claim 1, wherein said clip members have geometrically-shaped design structures such as rectangles, squares, circles, ovals, triangles and other geometrical designs.

7. A sanitary ear clip display member in accordance with claim 1, wherein said clip members have non-geometrically-shaped design structures.

8. A sanitary ear clip display member in accordance with claim 1, wherein said second clip member is a movable clip member.

9. A sanitary ear clip display member in accordance with claim 1, wherein said pin receiving member is made of a porous plastic material or a sponge-like material for receiving a pin of a pierced-type earring therethrough.

10. A sanitary ear clip display member for displaying a pierced-type earring, comprising:

a) an ear clip display member being substantially U-shaped in configuration and having a pin receiving member attached at one end to a movable clip member and said pin receiving member attached at the other end to a fixed clip member; said movable clip member and said fixed clip member each having a planar configuration;

b) a pivot pin and spring member attached to said one end of said pin receiving member and to one end of said movable clip member;

c) said movable clip member being movable in a spring-biased manner from an opened position to a closed position;

d) said pin receiving member being positioned parallel relative to each of said clip members;

e) said pin receiving member being made of a porous material or a sponge-like material for receiving a pin of the pierced-type earring therethrough; and f) said movable and said fixed clip members and said pin receiving member form said U-shaped configuration for forming a U-shaped channel therebetween in order to receive an ear lobe therein allowing the user to try on the pierced-type earrings in a sanitary manner.

11. A sanitary ear clip display member for displaying a pierced-type earring, comprising:

a) an ear clip display member being substantially U-shaped in configuration and having a pin receiving member attached at one end to a first movable clip member and said pin receiving member attached at the other end to a second movable clip member; and each of said movable clip members having a planar configuration;

b) a pivot pin and spring member attached to each end of said pin receiving member and attached to each of said first and second movable clip members;

c) each of said first and second movable clip members being movable in a spring biased manner from an opened position to a closed position;

d) said pin receiving member being positioned parallel relative to each of said clip members;

e) said pin receiving member having a pin receiving passageway for receiving a pin of the pierced-type earring therethrough for displaying the pierced-type earring; and f) said first and second movable clip members and said pin receiving member form said U-shaped configuration for forming a U-shaped channel therebetween in order to receive an ear lobe therein allowing the user to try on the pierced-type earrings in a sanitary manner.

* * * * *